US006827234B2

(12) United States Patent
Nicolini

(10) Patent No.: US 6,827,234 B2
(45) Date of Patent: Dec. 7, 2004

(54) EASY-TO-USE AUTOMATIC DISTRIBUTOR MACHINE USING ROTARY DISCS

(75) Inventor: Antonio Nicolini, Vicenza (IT)

(73) Assignee: Officine Meccaniche F.lli Manea S.r.l., Vicenza (IT)

( * ) Notice: Subject to any disclaimer, the term of this patent is extended or adjusted under 35 U.S.C. 154(b) by 237 days.

(21) Appl. No.: 10/264,367

(22) Filed: Oct. 4, 2002

(65) Prior Publication Data

US 2003/0066840 A1 Apr. 10, 2003

(30) Foreign Application Priority Data

Oct. 9, 2001 (IT) ..... MI2001A2077

(51) Int. Cl.[7] ..... G07F 11/00
(52) U.S. Cl. ..... 221/7; 221/124
(58) Field of Search ..... 221/7, 3, 9, 13, 221/15, 92, 123, 124, 129, 156, 268, 224, 277

(56) References Cited

U.S. PATENT DOCUMENTS 4,108,333 A * 8/1978 Falk et al. ..... 221/13
2003/0127463 A1 * 7/2003 Varis ..... 221/2

* cited by examiner

*Primary Examiner*—Kenneth W. Noland
(74) *Attorney, Agent, or Firm*—Hedman & Costigan, P.C.

(57) ABSTRACT

An easy-to-use automatic distributor machine (100) using rotary discs (103), of the type comprising a fixed structure (170) with at least one product-holding disc (103), rotating about its axis, and with at least one flap (150) for the collection of a product which has been selected. According to the invention, said machine (100) foresees at least one guide (120) for the sliding of a container (116), which collects the product selected near to the corresponding product-holding disc (103) and takes it into a collection position, accessible to the user opening the flap (150).

28 Claims, 13 Drawing Sheets

Fig.10
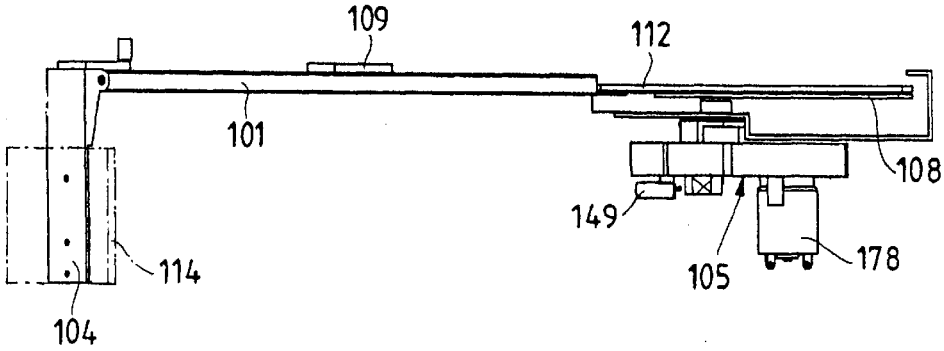
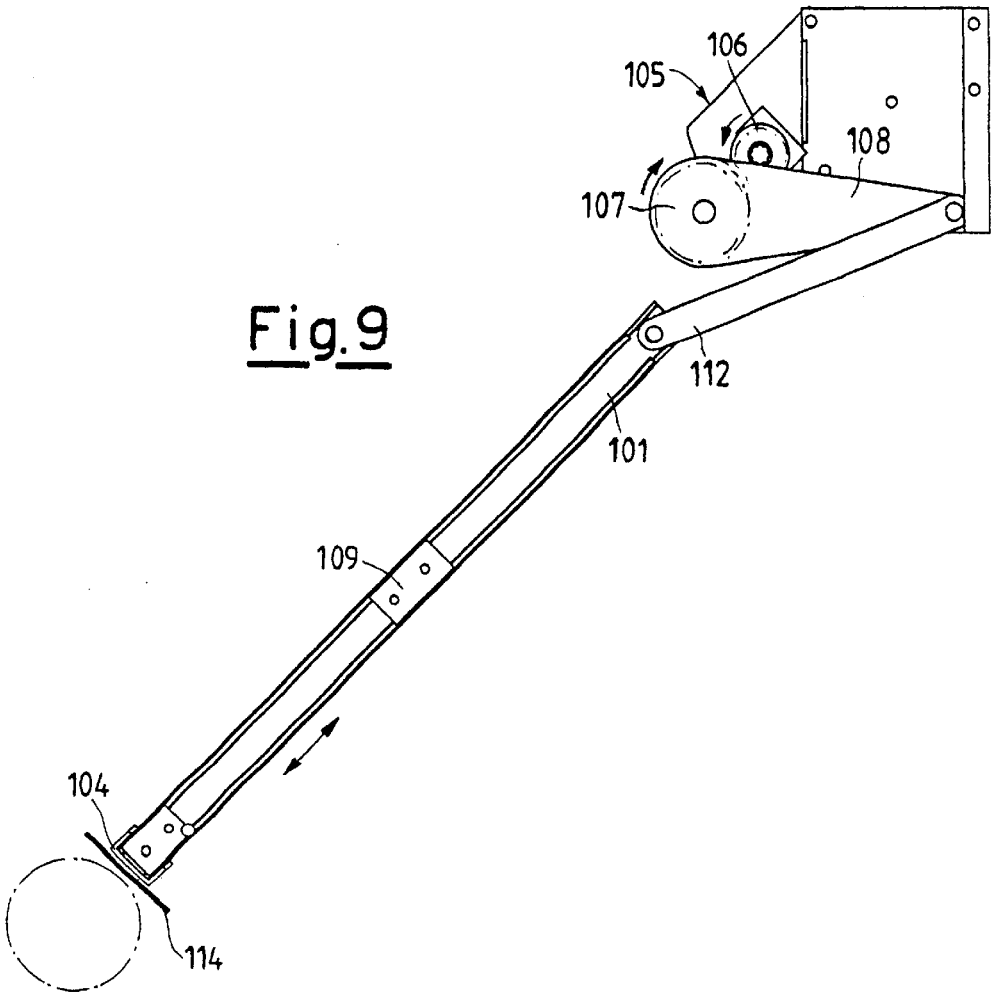
Fig.9

EASY-TO-USE AUTOMATIC DISTRIBUTOR MACHINE USING ROTARY DISCS

The present invention refers to an easy-to-use automatic distributor machine using rotary discs.

For widely consumed packaged products, such as cans, bottles, foodstuffs, pharmaceutical products or the like, there are automatic machines which distribute such products, following the selection and subsequent payment by the user.

Essentially, there are two types of machine which carry out such operations.

A first type is that of spiral distributors. After the user has selected and paid for a determined product available, such machines identify the predetermined product inside them, which is arranged on a shelf inside the machine, in a suitable compartment. The machine then makes it fall by gravity from the compartment into a collection tray below, where the user recovers the product by hand.

The tray is closed by a flap which can be opened, for example by pushing, and foresees a simple anti-theft system which prevents people from reaching a hand into the compartments inside the distributor.

This first type is generally used to dispense packaged products which do not suffer much from the bumps which they receive from the fall by gravity.

Indeed, with the system just described, it is obvious that the products distributed from the highest inner compartments can undergo substantial damage, as would happen in the case of bottles, for example made from glass. Moreover, the predetermined product can also get caught on its way down.

Furthermore, still with the first type of distributor described, cans of fizzy drink would get shaken up when falling, so much so that, when they are opened thereafter, the compressed gas inside would cause part of the drink to spill over.

This is the reason why a second type of machine is generally preferred for bottles and cans.

This second type is that of distributors with a rotary disc.

They allow the distribution both, as stated, of drinks packaged in bottles or cans, and of different packaged products.

After the user has selected and paid for a determined product available, such machine identify the predetermined product inside them, which is arranged on a shelf inside the machine, in a suitable disc. The disc is rotated to a withdrawal position which can be accessed by the user by opening a flap.

More specifically, such distributors using discs are substantially realised with two different technologies, strictly correlated with the type of products to be distributed.

However, in both cases, the withdrawing action requires that the user has access to the inside of the machine in a withdrawal step.

In the case of packaged products, the discs are divided into adjustable sections, in the shape of an angular sector, where the user is allowed to access and withdraw through the unlocking of the flap.

Since a flap is foreseen for each disc, it is clear that such a system is extremely delicate and expensive. Such flaps for accessing the product must be completely motorised, since it has to be guaranteed that they are closed during the rotation of the disc. If this were not to happen, the products would move forwards to the withdrawal point without any protection, and they would thus be accessible from the outside.

In other cases, the point of withdrawal is not protected by a flap, since the discs are left with an empty sector in correspondence with the point of withdrawal and they are made to rotate independently of a space so as to make the next product accessible.

On the other hand, in the case of bottles or cans of drink, the machines have the access space protected by a single vertical flap.

This, however, always remains free, allowing intrusion inside the distributor machine.

In both cases it is, in any case, impossible to realise a machine which can be used by all categories of user.

Indeed, the arrangement of the points of access to the product, for example in too high positions, does not make it easy to use for children or people with a disability.

Furthermore, automatic distributors using rotary discs currently manufactured have other drawbacks, such as:

difficult removal of the discs;
difficulty of adjustment of the spaces between one disc and another;
diversity of realisation of the machine for different applications;
possibility of intrusion by users from the outside;
complexity of construction of the unit with flaps and impossibility to adjust the spaces between the discs;
difficulty of removal of the refrigerating group of the machine.

The general purpose of the present invention is that of realising an easy-to-use automatic distributor machine using rotary discs, which allows easy access for all categories of user.

Another purpose of the present invention is that of realising an automatic distributor machine using rotary discs with simple adaptability of dispensing between bottles or cans of drink and different packaged products, such as to allow the same machine to be used to dispense any type of packaged product.

Another purpose of the present invention is that of avoiding a poorly controlled dispensing of the products distributed by an automatic machine, which could get stuck or damage themselves immediately prior to removal by the user.

Yet another purpose of the present invention is that of making it as easy as possible to remove the components and to adjust them.

A further purpose is that of realising an anti-theft system which prevents any possibility of access inside the machine, and precisely to the shelves which contain the products, in order to avoid theft by dishonest people or dangerous acts for the safety of the user.

A further purpose is that of overcoming the aforementioned drawbacks of the prior art in an extremely simple, cost-effective and particularly functional manner.

In view of the aforementioned purposes, according to the present invention, it has been thought of to realise an easy-to-use automatic distributor machine using rotary discs, having the characteristics outlined in the attached claims.

The structural and functional characteristics of the present invention and its advantages compared to the prior art shall become even clearer from an examination of the following description, referring to the attached drawings, which show an easy-to-use automatic distributor machine using rotary discs realised according to the innovative principles of the invention itself.

In the drawings:

FIG. 1 shows an overall axonometric view of a first embodiment of an automatic distributor machine using rotary discs of the present invention, with a sliding container represented at the top, in distributing position, opposite a product-holding disc, intended to contain cans or bottles of drink;

FIG. 2 is an overall axonometric view of the inside of a second embodiment of an automatic distributor machine using rotary discs of the present invention, with a sliding container represented at the top, in distributing position, opposite a product-holding disc, intended to contain generic packaged products, and at the bottom, in collection position, capable of being accessed by the user through a flap for collecting the product (not shown in this figure);

FIG. 9 is an enlarged plan view from above of a detail of FIG. 8, and precisely of an extractor group for generic packaged products;

FIG. 10 shows a side view of FIG. 9;

With reference to the aforementioned figures, in them an automatic distributor machine using rotary discs is shown, wholly indicated with 100 and equipped with a module for transporting products from the distribution point, at a product-holding disc 103, to the collection point, at a recovery flap 150, according to the present invention.

Figure 2:
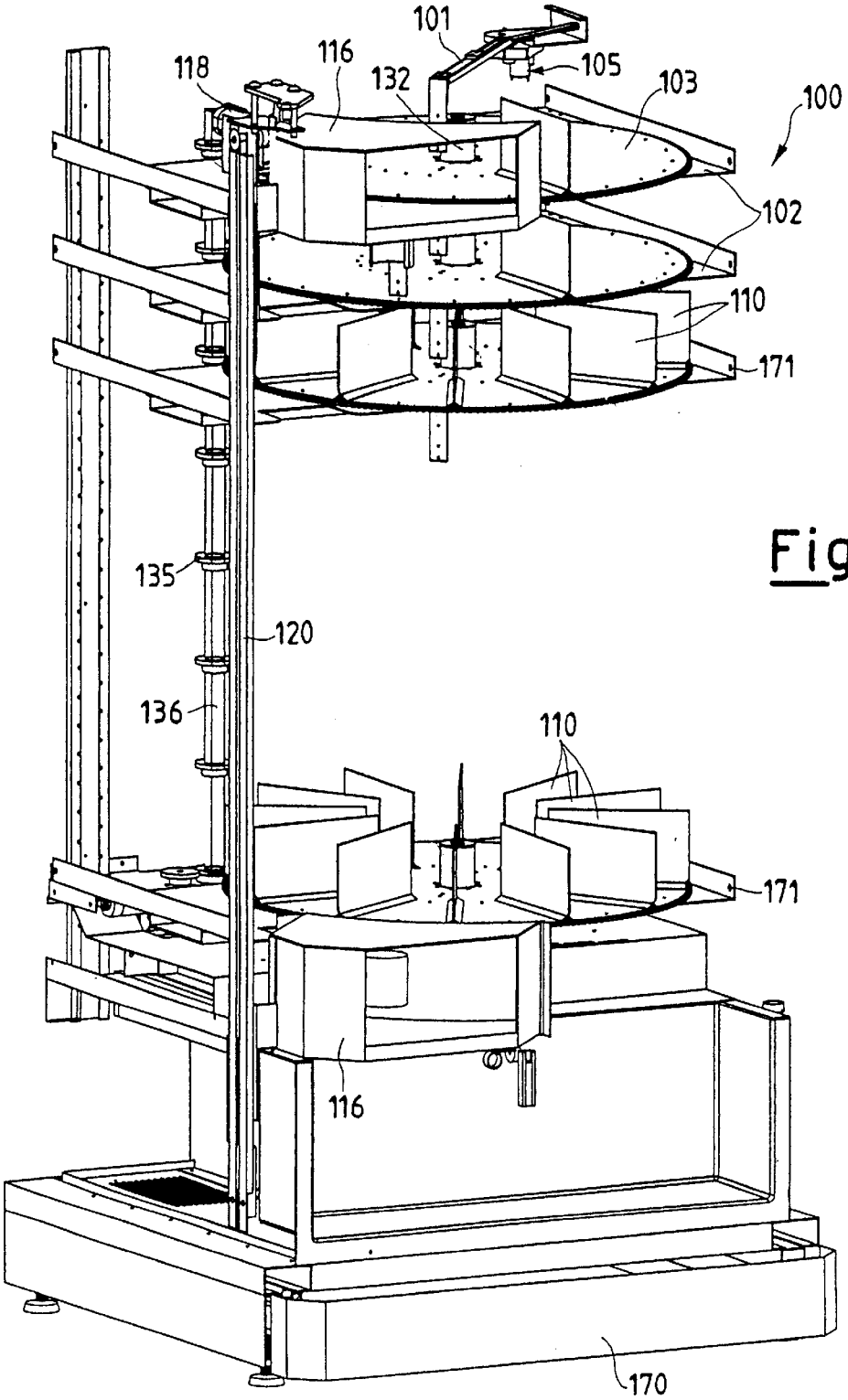
Figure 3:
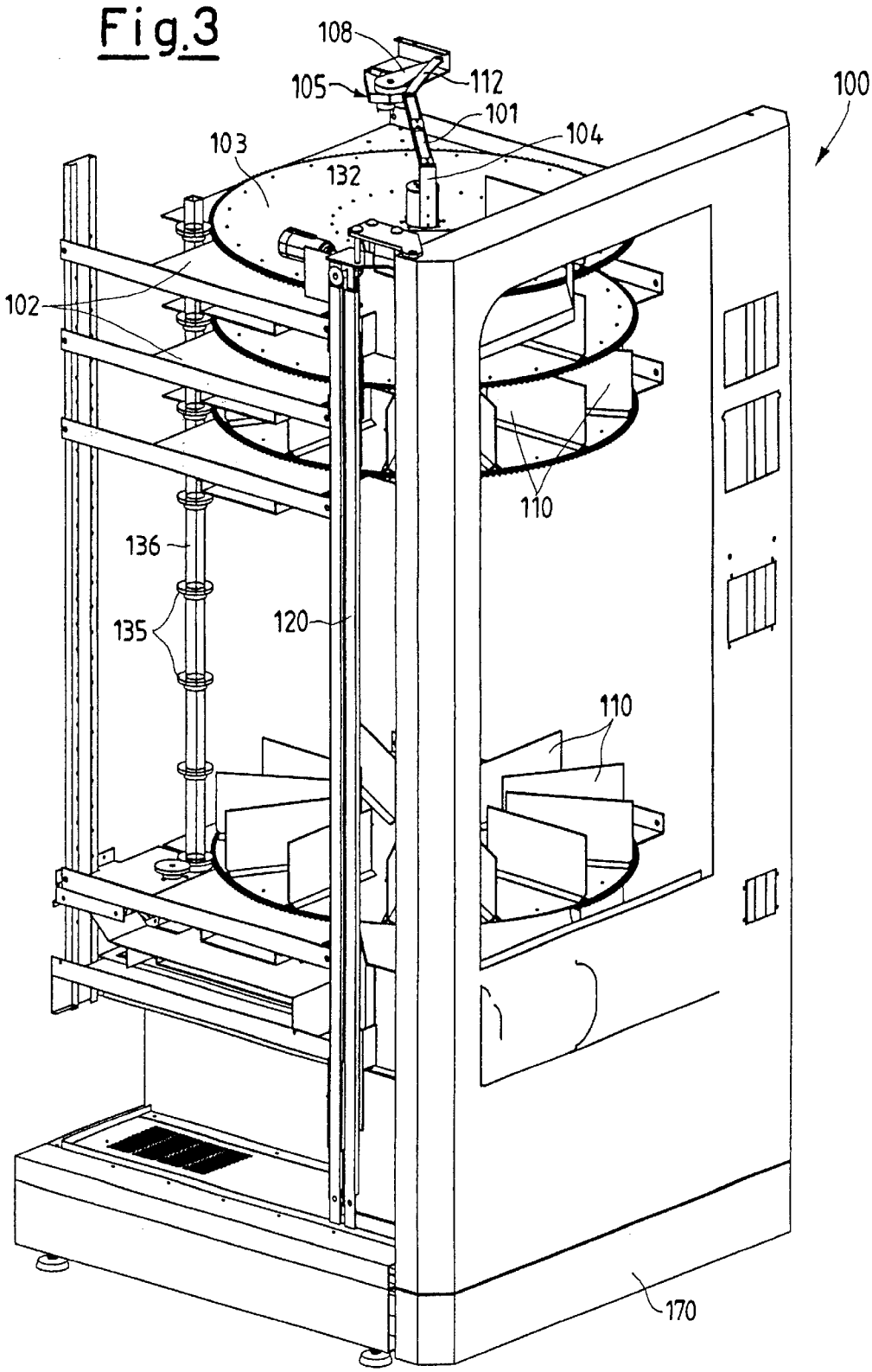
FIG. 3 shows a further overall axonometric view of the second embodiment of the invention of FIG. 2, where the outer front part of the machine can be seen, equipped with the product-collection flap.

As can be seen, for example in FIG. 2, the automatic distributor machine with rotary discs 100 has one or more shelves or support surfaces 102, each equipped with a product-holding disc 103.

Each support surface 102 is fixed to a frame or fixed structure 170 of the machine 100 using attachment means, such as pins in holes 171.

The discs 103 rotate on a central pin 132 present on each surface 102. Such a pin 132 can be mounted on a plate 172, which inserts horizontally into a recess 131 realised on each support surface 102, until a central position of the surface 102 itself.

Figures 6, 7:
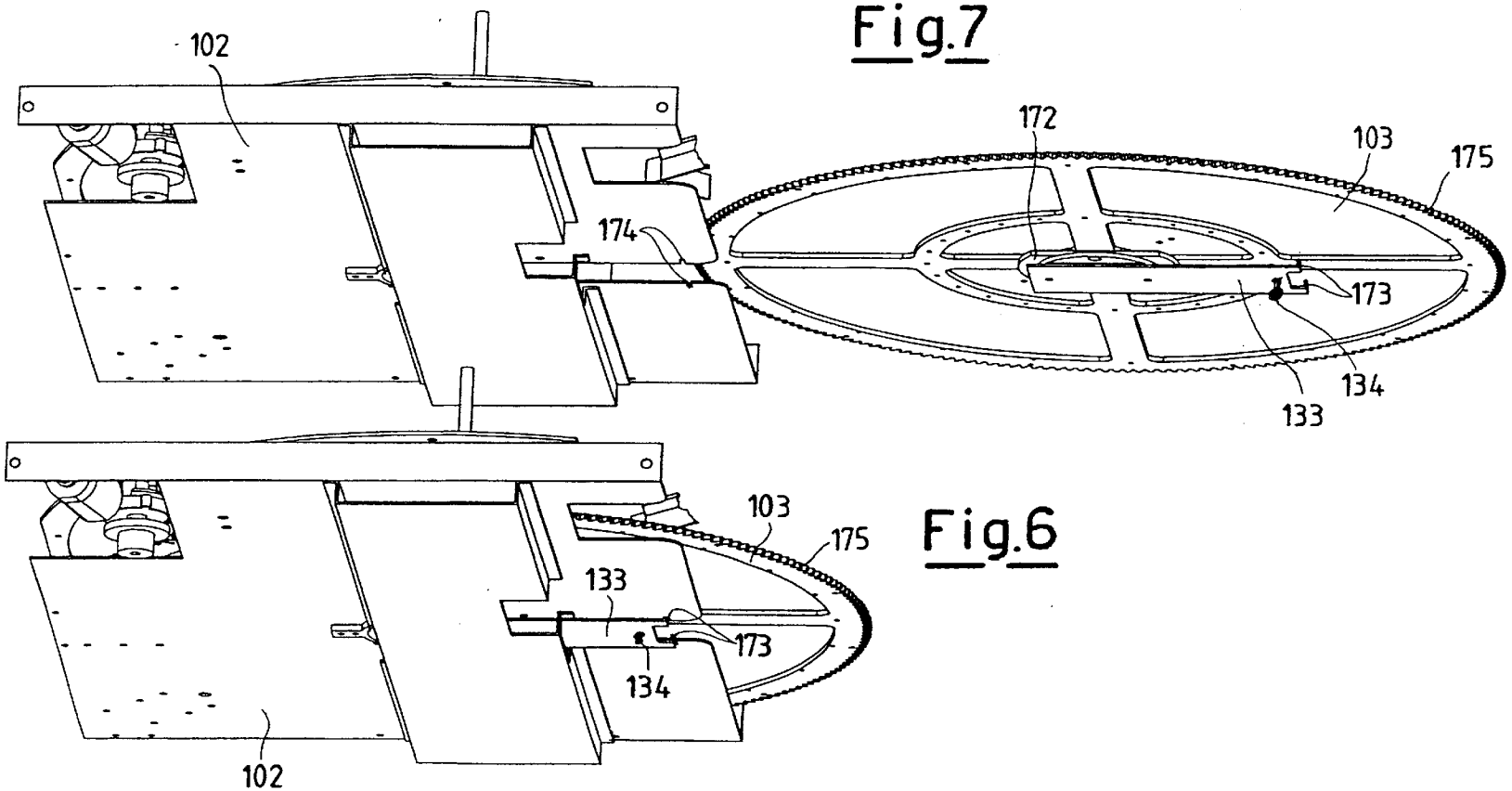
FIG. 6 is an enlarged axonometric view of a detail of FIG. 5, and precisely of a support shelf which carries a product-holding disc.
FIG. 7 is an exploded axonometric view of FIG. 6.

As can be seen in FIGS. 6 and 7, the plate 172 is locked by a leaf spring 133, equipped with two teeth 173 which are inserted into matching notches 174 realised on the surface 102, locking the plate 172, and consequently the disc 103, at the moment of insertion.

To withdraw the teeth 173 from the notches 174, a lower knob 134 is foreseen on the spring 133.

Figure 4:
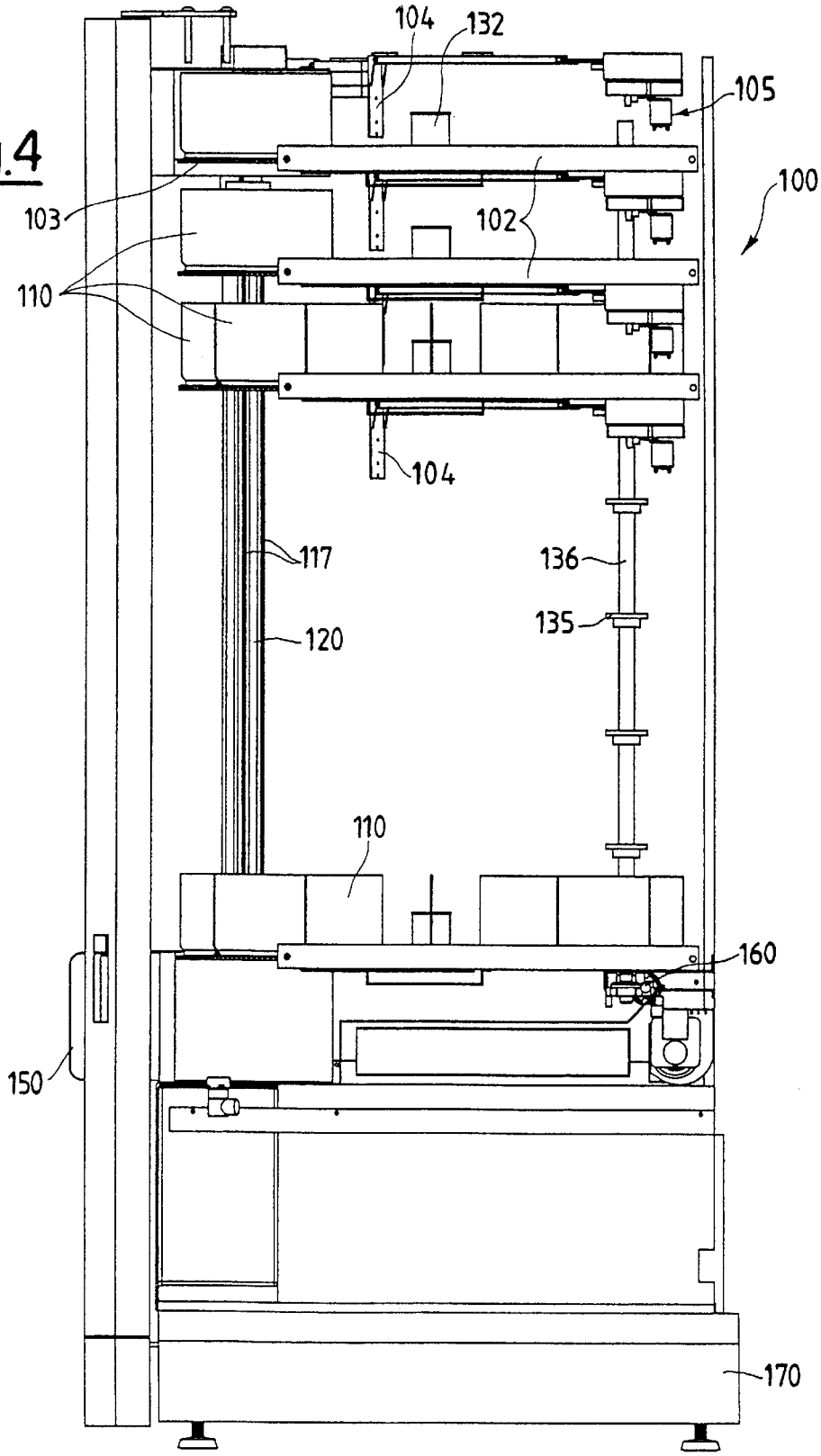
FIG. 4 is a side view of FIG. 3, where components suitable for rotating the discs can be seen.
Figure 5:
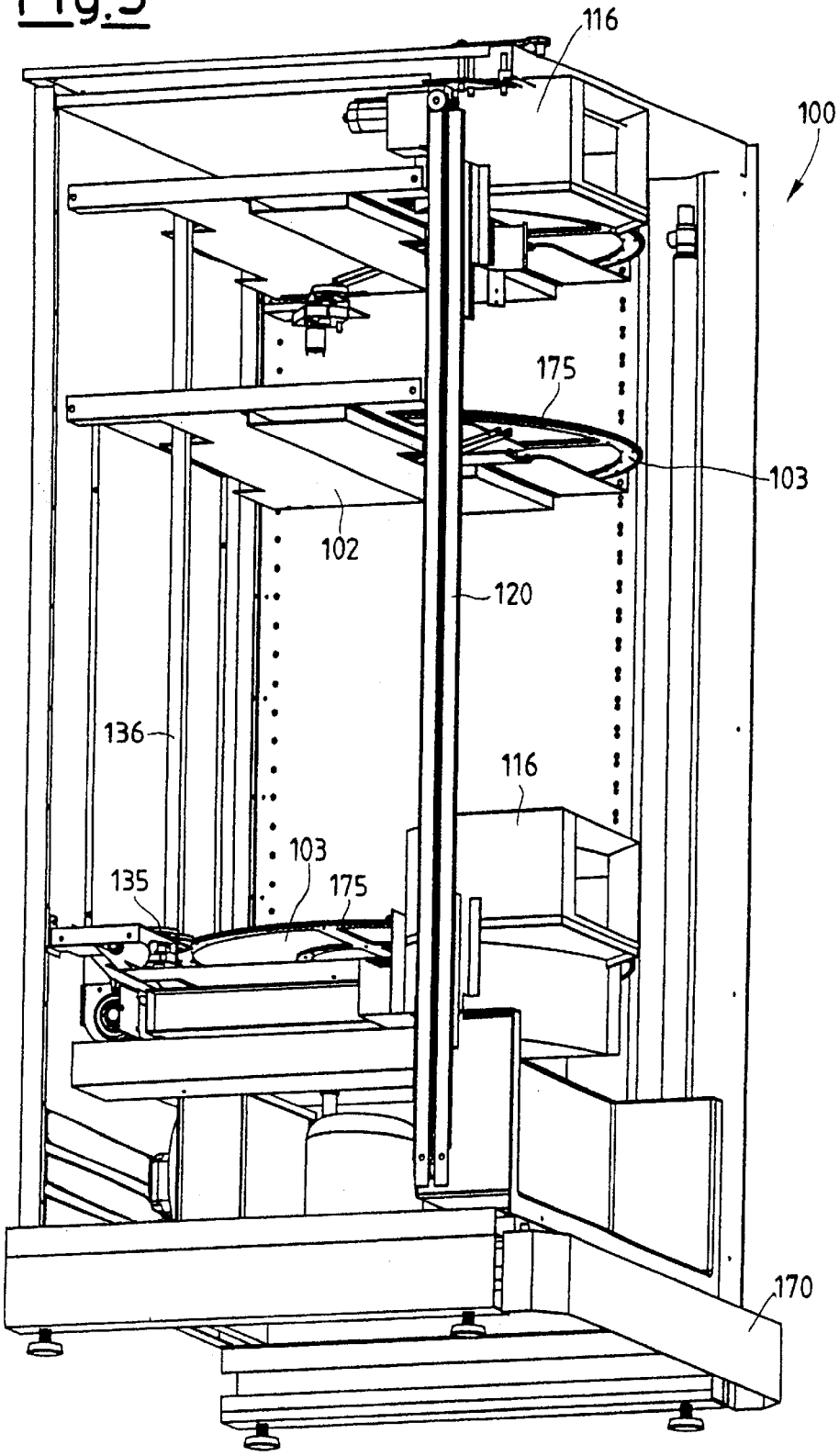
FIG. 5 shows an axonometric view from below of the machine of FIG. 2, where the support shelves for the product-holding discs can be seen.
Figure 8:
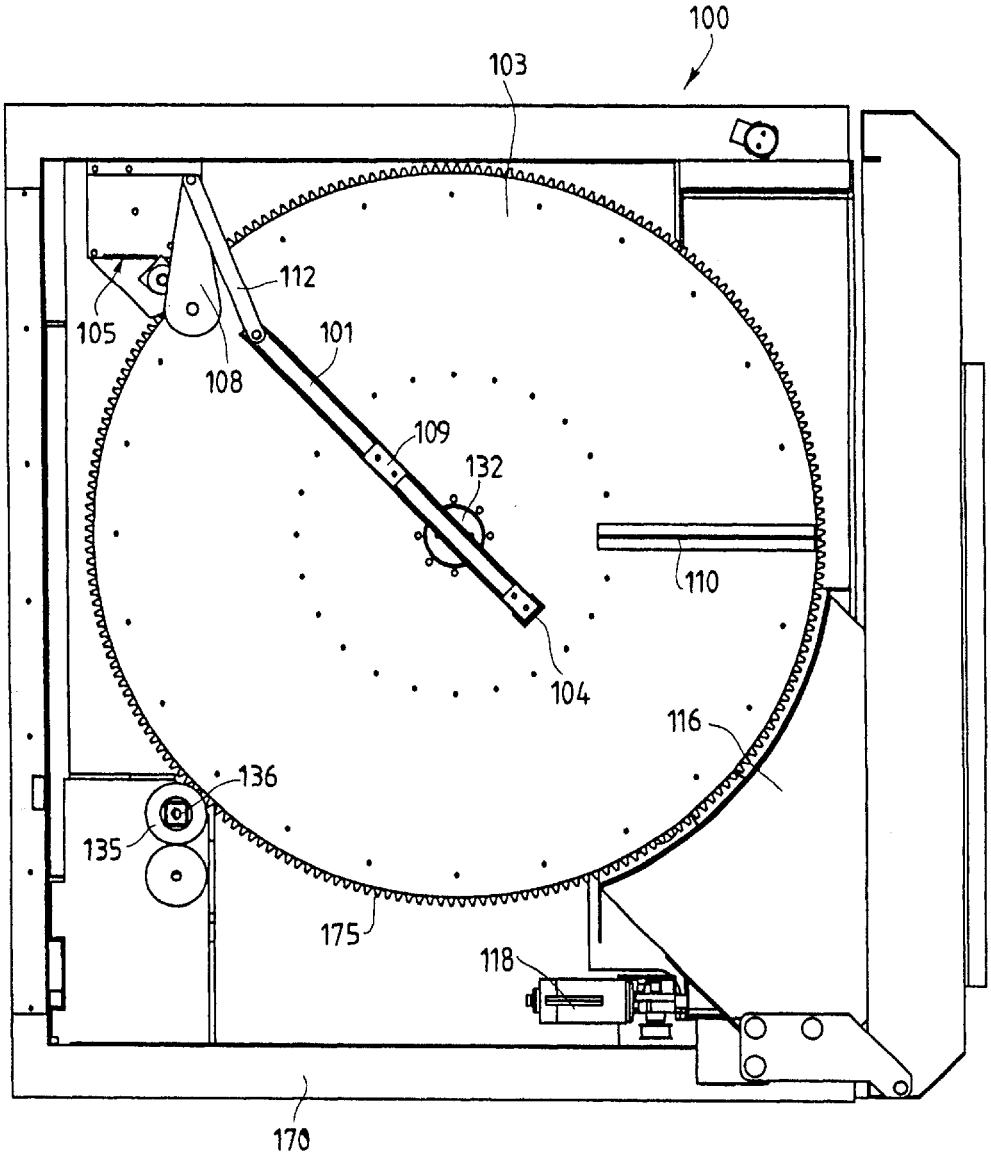
FIG. 8 shows a plan view from above of FIG. 3.

As is shown in FIG. 8, the disc 103 has a circumferential toothing 175, for example in correspondence with an outer end circumference thereof. Such toothing 175 engages on a sprocket 135 mounted on a transmission shaft 136. The shaft 136, which is vertical and connected to all of the discs 103, is supported on a base of the machine 100, and is made to rotate through a gearmotor 160, which can be seen in FIG. 4.

Alternatively, the rotation of the discs 103 can also be realised separately by motorising each sprocket 135 individually.

Figure 13:
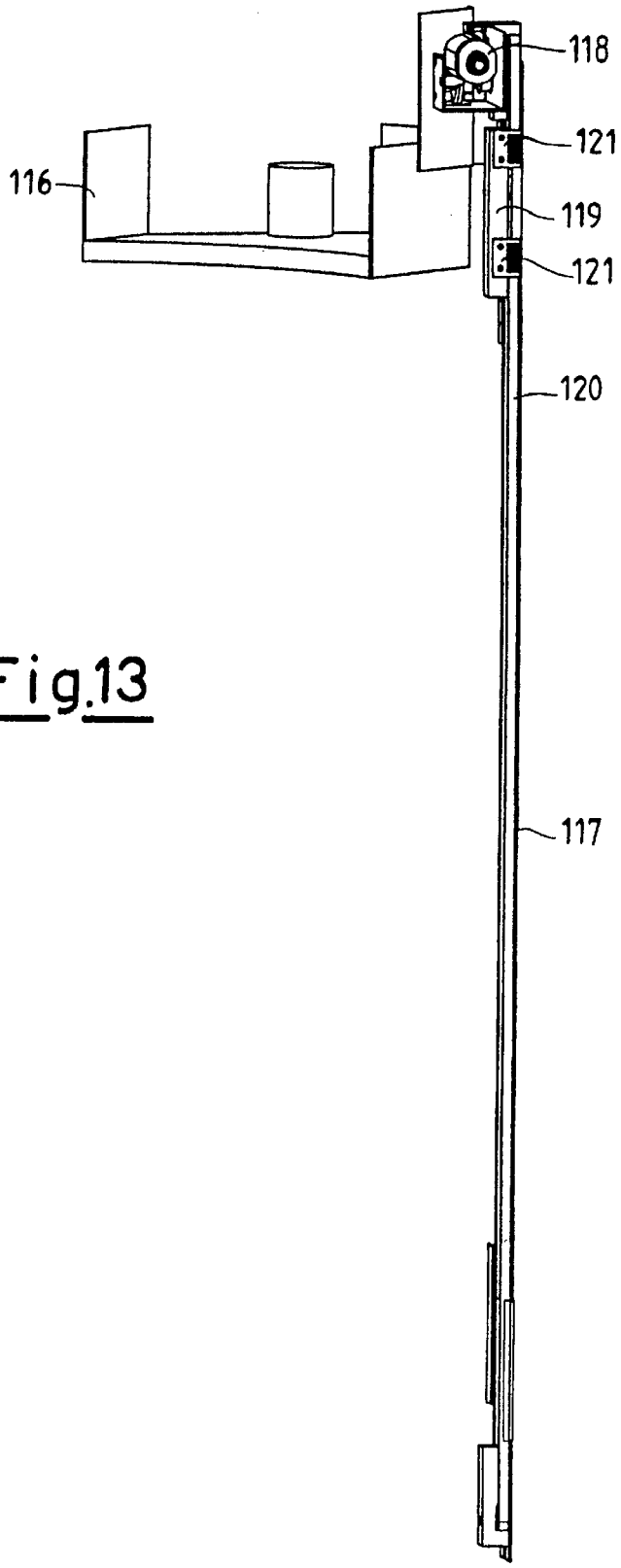
FIG. 13 is a partial axonometric view of FIG. 2, with the sliding container represented near to the distribution position for products.

In FIG. 13 the module for transporting products is highlighted.

Figure 1:
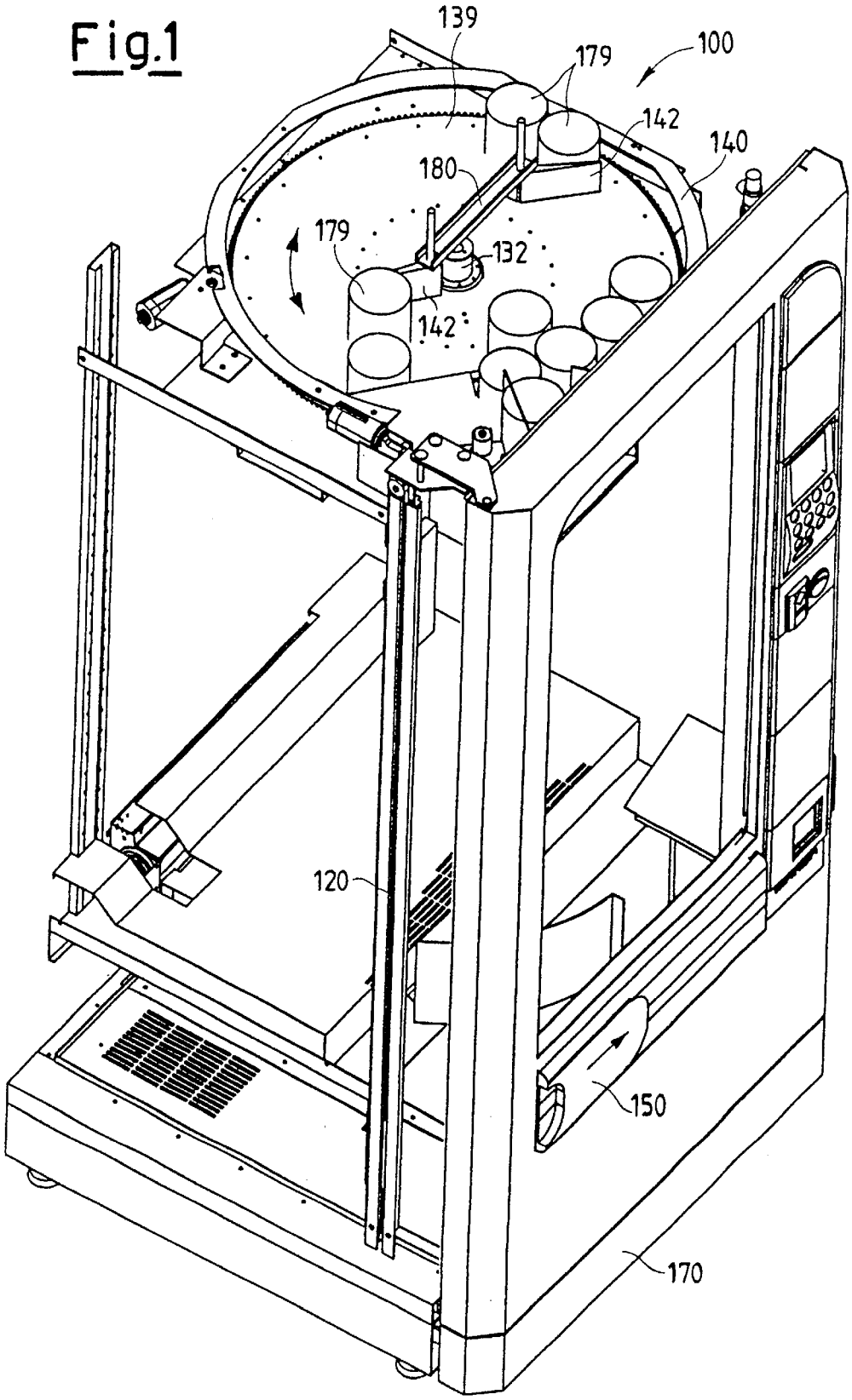

Such a module is essentially made up of a sliding container 116 which is positioned immediately below the product-holding disc 103 containing the product chosen by the user, receives it the an ejector mechanism 145, in the case of the first embodiment of the invention shown in FIG. 1, or else through a removal mechanism, in the case of the second embodiment shown, for example, in FIG. 2, and carries it to behind the flap 150 for the user to collect it.

The movement of the container 116 takes place through two guides or rails 120, fixed to the side walls of the distributor machine 100.

A small block 119, for example made from self-lubricating material, which is connected to the side of the container 116, slides in each guide 120.

The two ends of a belt 117 are fixed onto the block 119, connected to form a loop between two sheaves positioned at two ends of the guide 120, for example through two clamps or small plates 121.

One of the two belts 117 is controlled by an electric motor 118 and relative pulleys.

Taking account of the fact that the various support surfaces 102 can be variably distanced from each other according to the product loaded, the container 116 is equipped with a small hall effect probe, which detects its position with respect to the different surfaces 103. This takes place through the light touching of the probe by means of a magnet positioned on each surface 103.

In such a way the program for managing the machine has the information relative to the position of the container 116.

The guides 120 are also equipped with an upper and lower limit switch. Starting from the lower limit switch, where the reference in the collection position of the container 116 is made, the program for managing the machine can determine, through the probe placed on the container 116 itself, the surface 103, identified by its magnet, upon which to position itself to receive the selected product and then go back to the collection point.

Figure 14:
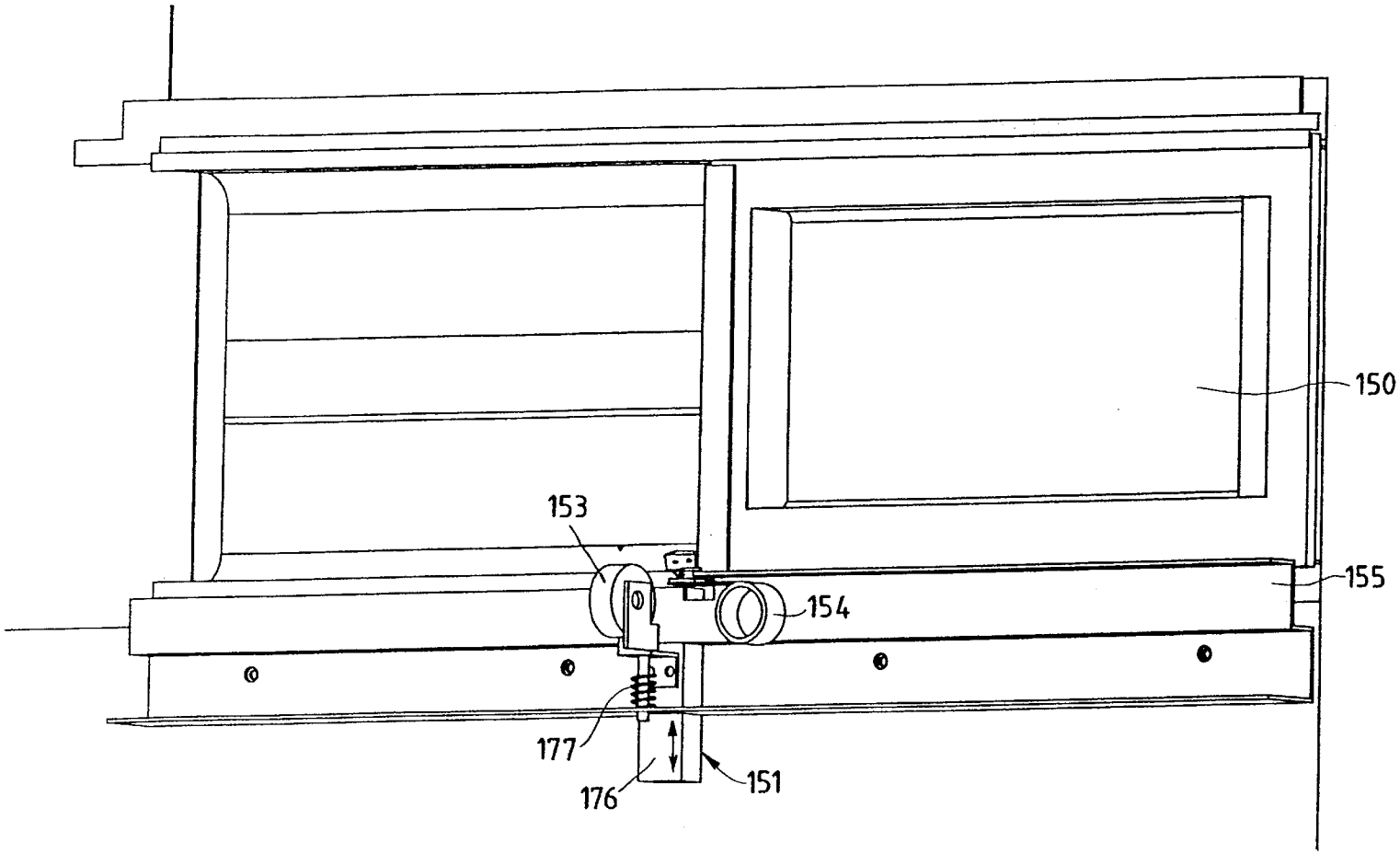
FIG. 14 represents an enlarged axonometric view of a detail of FIG. 1, and shows a lock mechanism for the flap, in locked position.

The collection point is closed by the recovery flap 150. It can slide sideways through an inner runner 155, shown in FIG. 14.

The flap remains locked by a closing latch 151 during operation of the machine. It comprises a pin 176 which slides vertically. A spring 177 keeps the pin 176 in a position which locks the horizontal sliding of the flap 150. Such a pin 176 is also connected to an unlocking cam 153, which disengages the pin 176 from the flap 150 when the container 116 reaches collection position.

Figure 15:
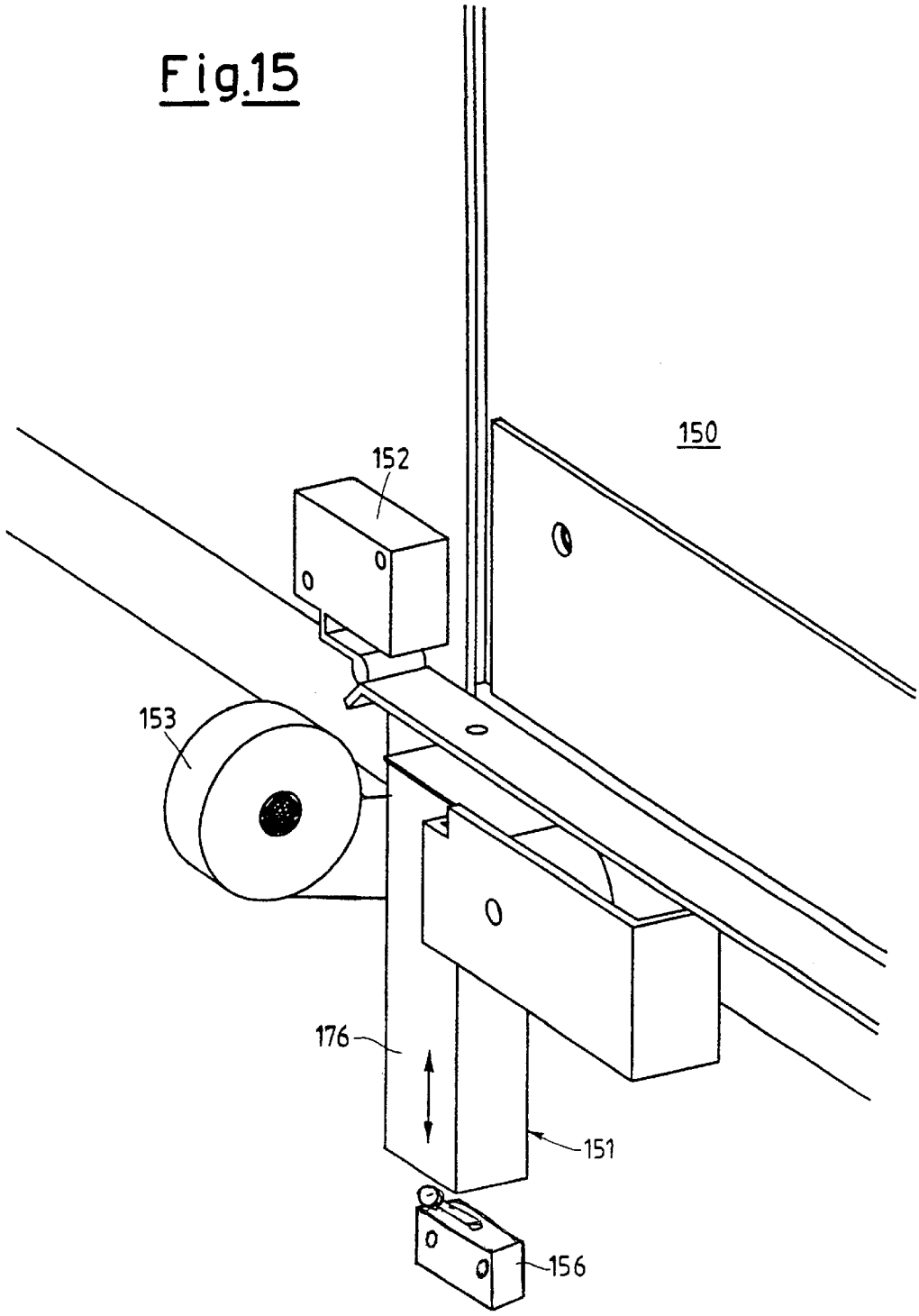
FIG. 15 is an enlarged axonometric view of a detail of FIG. 14, and more precisely shows the flap locking mechanism.

Such an unlocked position therefore corresponds to the position of the container 116 at the lower limit switch and is indicated by the microswitch 156, shown in FIG. 15.

Moreover, there is a sensor 152 which indicates whether the flap 150 is open or closed.

It thus provides information on the position of the flap 150 to the central microprocessor, programmed to manage the machine 100.

Once the collection operation is completed, the flap 150 automatically goes back to closed position, pushed by a return spring 154.

FIGS. 9 and 10 show the removal mechanism. Such a mechanism is used to push the products arranged on the disc 103 into the container 116, said discs 103, as can be seen in FIGS. 2 and 8, being equipped with dividing walls or dividers 110, arranged radially to separate the various products, which start in correspondence with an inner circumference of the disc 103 to reach near to an end circumference of the disc 103.

The mechanism comprises, for each disc 103, a shaft 101, capable of sliding in a horizontal direction towards the container 116, above the dividers 110 of each disc 103, for example on a lower part of the surface 102 placed above the disc 103 being used. The shaft 101 is equipped with a vertical paddle 104 which can be adjusted in height according to the products contained on the disc 103, and with a motor unit 105.

The motor unit 105 comprises an electric motor 178, of the same type used to move the springed selection groups of spiral machines.

The motor 178 moves a main sprocket 106, upon which there is a sensor 149 capable of transmitting an impulse for each complete rotation of the wheel 106.

The main wheel 106 is engaged with a secondary wheel 107, integral with a crank 108. The crank 108 is rotatably connected, in correspondence with an end thereof opposite the wheel 107, to a connecting rod 112.

The connecting rod 112 is rotatably connected to an end of the shaft 101 and thus takes care of the transformation of the circular motion of the crank 108 into linear motion of the shaft 101. Such a movement takes place according to the direction set by the position of a block 109, for example made of self-lubricating plastic material, capable of acting as a guide for the shaft itself.

The stroke of the shaft is foreseen so that the paddle 104, fixed at an opposite end to the binding with the connecting rod 112, is, at the minimum point, within the inner circumference tangent to the inner circumference from where the dividers 110 extend and, after its maximum extension, slightly beyond the maximum circumference of the toothing 175 of the disc 103.

The paddle 104 at rest is situated within the inner circumference from where the dividers 110 extend, so as not to interfere with them during the rotation of the disc 103.

The paddle 104 can be adjusted both in height, so as to compensate for the possible different distances between one disc 103 and the next, and in width, so as to be able to pass between the gaps formed by the adjacent dividers 110. The extreme side parts of the paddle 104 are formed from a sheet of flexible plastic material 114, so as to eliminate possible tiny errors in positioning of the disc 103.

Figure 11:
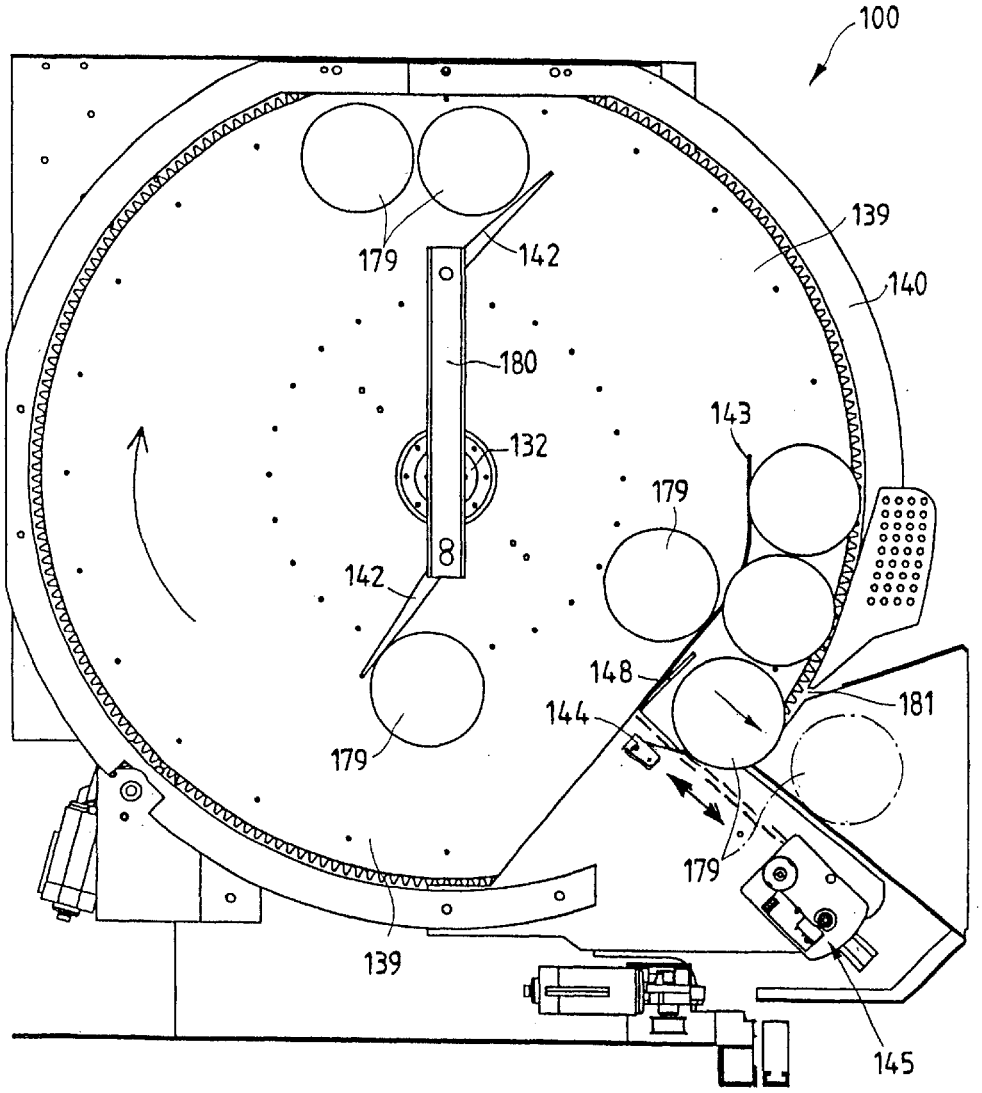
FIG. 11 is a plan view from above of FIG. 1.

The same machine 100 can be intended for the distribution of drinks, or consumer products in general, packaged in cylindrical packages, such as bottles, cans or tins 179, as can be seen, for example, in FIG. 11.

For this purpose the same disc 103 already described, without the dividers 110, can be used.

Outside of the disc 103, and for almost the whole outer circumference of the disc 103 itself, an essentially cylindrical side bulkhead 140 is arranged, which acts as a container so that the products do not come out.

A special slippery coating 139, capable of reducing to a minimum the friction of the bottles 179 on the disc 103 is placed upon the disc itself 103.

The disc 103, still equipped with a toothing 175 in correspondence with its end outer circumference, is made to rotate in the same way as that which was stated previously.

Deviator paddles 142 capable of conveying the bottles 179 towards the outside of the disc 103, during its rotation, are fixed above each disc 103, disengaged from the disc 103 itself and in a position integral with the frame 170 of the machine 100.

In practice, this can be realised by fixing, below and in correspondence with the two ends of a shaft 180, two flat paddles 142 which are perpendicular with respect to the disc 103. The paddles are arranged parallel to each other and towards the outside of the shaft 180, forming an acute angle with the axis of the shaft 180. The shaft 180, of a size smaller than the diameter of the disc 103, is arranged, disengaged from the disc 103 itself and in a position integral with the frame 170 of the machine 100, above a diameter of the disc 103, the centre of the shaft 108 being misaligned with respect to the centre of the disc 103.

The side wall 140 foresees an opening 181 where the ejector mechanism for the bottles 179 acts.

Referring to the direction of rotation of the disc 103, before reaching the opening 181, there is a bulkhead 143, approximately parallel to the side bulkhead 140 and distanced from the side bulkhead 140 itself by slightly more than the diameter of the bottle 179.

The bottle 179 which remains between the bulkhead 143 and the side bulkhead 140, reaches a hooking arm 148, forming part of the ejector mechanism.

A sensor 144 is placed in such a zone and indicates the presence of the bottle 179 in that zone.

Figure 12:
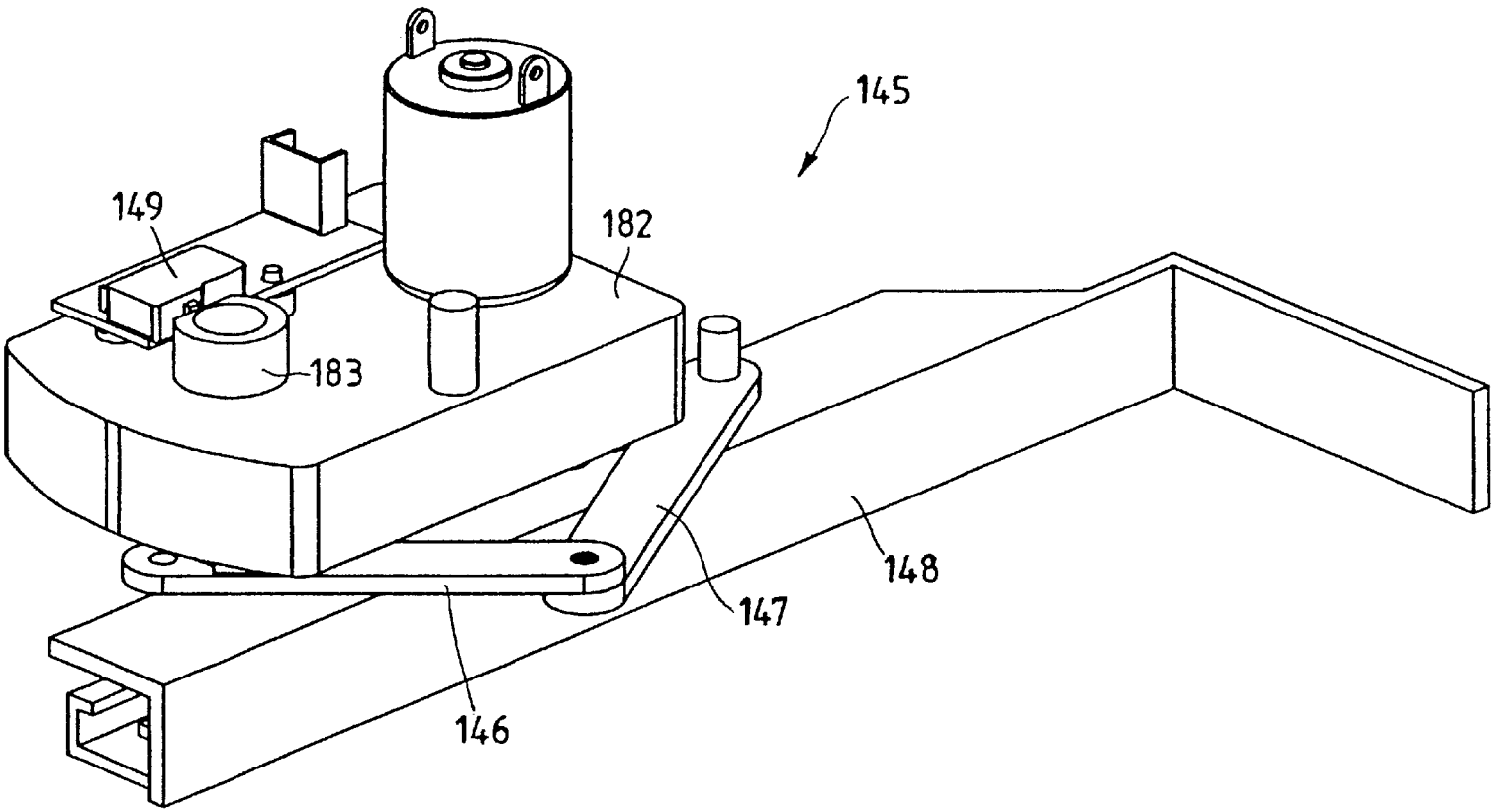
FIG. 12 shows an enlarged axonometric view of a detail of FIG. 11, and precisely of an ejector group for cans or bottles.

The ejector mechanism, wholly indicated with 145, can be seen in FIG. 12 and comprises an electric motor 182 which moves a crank 146 of a connecting rod group 147 and crank 146. The connecting rod 147 is rotatably connected at one end to the hooking arm 148 of the bottle 179. The motor 182 is equipped with a sensor 149. A cam 183 for activating the sensor 149 is actuated if the sensor 144 for detecting the presence of a bottle 179 confirms the actual presence of the product to be distributed.

The operation of the easy-to-use automatic distributor machine using rotary discs according to the invention is clear from that which is described above with reference to the figures, and in brief is the following.

When a product is selected, the machine 100 identifies the product-holding disc 103 which contains it. Through a rotation mechanism, the disc 102 is rotated up to a suitable position, in which an ejector mechanism 145, in the case of the first embodiment of the invention shown in FIG. 1, or else a removal mechanism, in the case of the second embodiment shown for example in FIG. 2, makes the predetermined product fall in the container 116.

The container 116 slides vertically and goes into the zone in front of the predetermined product-holding disc 103, before the ejector or removal mechanism 145 acts.

Then the container 116 transports the products from the distribution point, at the product-holding disc 103, to the collection point, at the recovery flap 150, integral with the frame 170 of the machine 100.

The rotation of the disc 103 is controlled by an encoder, interfaced with a microprocessor.

In the case shown in FIG. 2 of products separated from each other by divider walls 110, the microprocessor establishes, based upon how many divisions have been realised on the discs 103, where to lock the rotation, so that the product chosen is in ejection position. The container 116 positions itself at the height of the disc 103 in which the product has been selected. The activation of the ejector mechanism 145 allows the paddle 104, connected to the shaft 101, to push the object to be distributed beyond the disc 103 until it makes it fall into the container 116, through which it is taken to the collection flap 150.

In the case shown in FIG. 11 of products packaged in bottles or cans 179, a bottle 179 arranged inside the disc 103 meets, during the rotation of the disc 103, the two paddles 142 in succession, which deviate it towards the outside of the disc 103, up to the side bulkhead 140.

The bulkhead 143 stacks up the bottles 179 in front of an ejection zone. When the first product reaches the precise ejection point, it stops the column of products which slide on the coating 139.

The ejection mechanism 145, with the connecting rod 147 connected to the crank 146, makes the hooking arm 148 carry out a rectilinear stroke, during which it displaces the can or the bottle 179 towards the transportation container 116.

The module for transporting the product then transports the bottle 179 up to the collection flap 150.

As far as the transportation module is concerned, there are two blocks 119 parallel to each other, so as to make the container 116 stable eliminating vibrations as much as possible. The transportation belt 117 can be fixed onto one of the two blocks 119, whereas the other block 119 remains free since it has only the function of a stabiliser.

The rotation of the shaft of the electric motor 118 thus definitively controls the vertical movement of the container 116 which has thus the possibility of positioning itself in correspondence with the different surfaces 102 and in the collection position, behind the flap 150.

The movement of the container 116 is therefore like the movement of an elevator which moves vertically with respect to the machine 100.

The container 116 also takes care of unlocking the flap 150 for retrieving the product. The flap 150, indeed, must remain closed during all of the distribution operations and must be able to open once the product has reached the collection point.

Based upon the compilation of management software of the machine, a central processor is capable of regulating the vertical movement of the container 116 so as to activate it only in the case of perfect closing of the flap 150.

It is, indeed, essential that the mechanical movements take place in perfect safety. No user must have the possibility of access inside the machine 100 during the movement of the container 116 or of the discs 103, thus guaranteeing the respect of the safety regulations.

All of the operations of the machine 100 and the indications to the user are indicated by a display in real time.

The transportation container 116, upon arrival in the product collection position, unlocks the sliding mechanism of the flap 150, acting upon the unlocking cam 153.

During the movement of the container 116 the flap 150 remains closed, and is unlocked only when the container 116 is in collection position: this is designed so that the user does not jeopardise his safety by introducing his hands when the container 116 is moving.

The engagement of the microswitch 156 provides the program for managing the machine with the information that the container 116 is in collection position.

The information provided by the microswitch 156 is processed by the program for managing the machine 100 in such a way that, until the flap 150 is open, the container 116 stays still, even in the case in which there is already a request for the withdrawal of another product.

The easy-to-use automatic distributor machine using rotary discs according to the invention has numerous advantages.

Amongst these, it should be noted that the components used integrate extremely well with those of spiral automatic machines.

Moreover, it is guaranteed that the elements, in particular the discs to be used, are easy to remove and adjust.

Advantageously, discs equipped with dividers, for miscellaneous packaged products, and discs without dividers, for products in a bottle or can, can be inserted inside the machine itself.

With all this a high versatility of the products which can be dispensed by the machine is obtained, since by replacing just the discs, which in practice constitute inner modules, the machine can be transformed, for example, from a distributor of bottles or cans to a distributor of different packaged products, or vice-versa.

From that which is described above with reference to the figures, it is clear how an easy-to-use automatic distributor machine using rotary discs, according to the invention is particularly useful and advantageous.

The purposes mentioned in the preamble of the description are thus achieved.

Moreover, the transportation module of the products from the distribution point, at a support surface, to the collection point, can be added on to an automatic distributor machine using rotary discs, in the case in which we are dealing with products for which the use of it is recommended.

With the transportation module according to the invention, it can also be foreseen to open many flaps for collecting the selected products, each in correspondence with every surface of the distributor machine. In such a way the displacement times of the sliding container are reduced, having only to receive the product in correspondence with the surface where it is contained, and no longer having to go back to a fixed collection position.

Alternatively, a single collection flap can be positioned no longer at the bottom, but in the centre of the machine, in order to minimise, on average, the displacements between the different surfaces and the single collection point of the machine.

Of course, the shapes of the easy-to-use automatic distributor machine using rotary discs of the invention can be different from those shown as a non-limiting example in the drawings, as can the materials be different.

The scope of protection is therefore defined by the attached claims.

What is claimed is:

1. Easy-to-use automatic distributor machine (100) using rotary discs (103), of the type comprising a fixed structure (170) with at least one product-holding disc (103), rotating about its axis, and with at least one flap (150) for the collection of a product which has been selected, characterised in that said machine (100) foresees at least one guide (120) for the sliding of a container (116), which collects the product selected near to the corresponding product-holding disc (103) and takes it into a collection position, accessible to the user opening the flap (150).

2. Automatic distributor machine (100) according to claim 1, characterised in that said flap (150) is equipped with an anti-theft mechanism (151, 153, 156, 176, 177), which prevents access to the product-holding discs (103) by the user.

3. Automatic distributor machine (100) according to claim 2, characterised in that said anti-theft system (151, 153, 156, 176, 177) comprises at least one pin (176) which stops the opening of said flap (150), when the container (116) is not in collection position.

4. Automatic distributor machine (100) according to claim 3, characterised in that said pin (176) is disengaged from said flap (150), when the container (116), in collection position, displaces an unlocking cam (153) connected to the pin (176) itself.

5. Automatic distributor machine (100) according to claim 1, characterised in that said container (116) slides on the guide (120) through a block (119), connected to the container (116) itself and to a belt (117), moved by an electric motor (118).

6. Automatic distributor machine (100) according to claim 1, characterised in that said container (116) provides the program for managing the machine with its position through the information coming from a probe, integral with the container (116) itself, which identifies the product-holding discs (103) of the machine (100).

7. Automatic distributor machine (100) according to claim 1, characterised in that said product-holding disc (103) has a circumferential toothing (175) in correspondence with an end outer circumference thereof, said toothing (175) engaging on a sprocket (135) mounted on a transmission shaft (136).

8. Automatic distributor machine (100) according to claim 7, characterised in that said transmission shaft (136) is connected to all of the discs (103) present in the machine (100) and is made to rotate through a gearmotor (160).

9. Automatic distributor machine (100) according to claim 1, characterised in that said product-holding disc (103) has a circumferential toothing (175) in correspondence with its end outer circumference, said toothing (175) engaging on a sprocket (135) connected to a gearmotor.

10. Automatic distributor machine (100) according to claim 1, characterised in that said product-holding disc (103) is supported by a support surface (102), fixed to said fixed structure (170) of the machine (100) using attachment means.

11. Automatic distributor machine (100) according to claim 10, characterised in that said disc (103) rotates on a central pin (132) present on each surface (102).

12. Automatic distributor machine (100) according to claim 11, characterised in that said pin (132) is mounted on a platelet (172), which inserts horizontally into a recess (131) realised on each support surface (102), until it reaches a central position of the surface (102) itself.

13. Automatic distributor machine (100) according to claim 12, characterised in that said platelet (172) is locked by a leaf spring (133), equipped with teeth (173), which insert into matching notches (174) realised on the surface (102), locking the platelet (172), and consequently the disc (103), at the time of insertion.

14. Automatic distributor machine (100) according to claim 13, characterised in that for the disinsertion of said teeth (173) from the notches (174), a lower knob (134) is foreseen on said spring (133).

15. Automatic distributor machine (100) according to claim 1, characterised in that said disc (103) is equipped with divider walls or dividers (110), arranged radially to separate the various products to be distributed, which extend from in correspondence with an inner circumference of the disc (103) to reach up to near to an end circumference of the disc (103).

16. Automatic distributor machine (100) according to claim 15, characterised in that, for each disc (103), there is a shaft (101) capable of sliding in a horizontal direction directly towards the container (116), above the dividers (110) of each disc (103).

17. Automatic distributor machine (100) according to claim 16, characterised in that said shaft (101) is equipped with a vertical paddle (104) capable of being adjusted in height according to the products contained on the disc (103), and is moved by a motor unit (105).

18. Automatic distributor machine (100) according to claim 17, characterised in that said motor unit (105) comprises an electric motor (178), which moves a main sprocket (106), engaged with a secondary wheel (107), integral with a crank (108), said crank (108) being rotatably connected, in correspondence with an end thereof opposite the wheel (107), to a connecting rod (112) rotatably connected to an end of the shaft (101).

19. Automatic distributor machine (100) according to claim 18, characterised in that the stroke of said shaft (101) is foreseen so that the paddle (104), fixed at an opposite end to the binding with the connecting rod (112), is, at the minimum point, within the inner circumference tangent to the inner circumference from where the dividers (110) extend and, after its maximum extension, slightly beyond the maximum circumference of the toothing (175) of the disc (103).

20. Automatic distributor machine (100) according to claim 17, characterised in that said paddle (104) can be adjusted both in height, so as to compensate for the possible different distances between one disc (103) and the next, and in width, so as to be able to pass between the gaps formed by the adjacent dividers (110).

21. Automatic distributor machine (100) according to claim 20, characterised in that said extreme side parts of said paddle (104) are formed from a sheet of flexible plastic material (114), so as to eliminate possible tiny errors in positioning of the disc (103).

22. Automatic distributor machine (100) according to claim 1, characterised in that a cylindrical side bulkhead (140), which acts as a container so that the products do not fall out, is arranged outside of said disc (103).

23. Automatic distributor machine (100) according to claim 22, characterised in that a special slippery coating (139) is placed upon the disc (103), and in that deviator paddles (142) capable of conveying cylindrical packages such as bottles, cans or tins (179) towards the outside of the disc (103), during its rotation, are fixed above each disc (103), disengaged from the disc (103) itself and in a position integral with the fixed structure (170) of the machine (100).

24. Automatic distributor machine (100) according to claim 23, characterised in that below and in correspondence with the two ends of a shaft (180), two flat paddles (142) which are perpendicular with respect to the disc (103) are fixed, said paddles (142) being arranged parallel to each other and towards the outside of the shaft (180).

25. Automatic distributor machine (100) according to claim 24, characterised in that said paddles (142) form an acute angle with the axis of the shaft (180), said shaft (180), of a size smaller than the diameter of the disc (103), being arranged, disengaged from the disc (103) itself and in a position integral with the fixed structure (170) of the machine (100), above a diameter of the disc (103), where the centre of the shaft (108) is misaligned with respect to the centre of the disc (103).

26. Automatic distributor machine (100) according to claim 22, characterised in that said side bulkhead (140) foresees an opening (181) where an ejector mechanism (145) for cylindrical packages (179) acts.

27. Automatic distributor machine (100) according to claim 26, characterised in that, referring to the direction of rotation of the disc (103), before reaching the opening (181), on the disc (103) itself there is a bulkhead (143), approximately parallel to the side bulkhead (140) and distanced from the side bulkhead (140) itself by slightly more than the diameter of the cylindrical package (179) present on the disc (103), where between said bulkhead (143) and said side bulkhead (140) there remains at least one cylindrical package (179) which arrives at a hooking arm (148), forming part of the ejector mechanism (145).

28. Automatic distributor machine (100) according to claim 27, characterised in that said ejector mechanism (145) comprises an electric motor (182) which moves a crank (146) of a connecting rod (147) and crank (146) group, said connecting rod (147) being rotatably connected at one end to said hooking arm (148).

* * * * *